United States Patent [19]

Prestwich

[11] 4,116,590

[45] Sep. 26, 1978

[54] DIAPHRAGM PUMP WITH PULSE PISTON POSITION RESPONSIVE WORK FLUID REPLENISHMENT

[75] Inventor: John Richard Prestwich, Reading, England

[73] Assignee: Warwick Pump and Engineering Company Limited, Berinsfield, England

[21] Appl. No.: 760,665

[22] Filed: Jan. 19, 1977

[30] Foreign Application Priority Data

Jan. 20, 1976 [GB] United Kingdom ..... 2126/76
Oct. 1, 1976 [GB] United Kingdom ..... 40782/76

[51] Int. Cl.[2] ..... F04B 9/10; F04B 35/02; F04B 43/06; F01B 19/02

[52] U.S. Cl. ..... 417/387; 417/388; 417/395; 92/13.2; 92/98 R; 92/103 SD

[58] Field of Search ..... 417/387, 386, 388, 395; 92/13.2, 103 R, 103 SD, 103 F, 98 R

[56] References Cited

U.S. PATENT DOCUMENTS

| | | | |
|---|---|---|---|
| 2,267,280 | 12/1941 | Kuhnel | 417/480 |
| 2,871,789 | 2/1959 | Kiffer | 417/395 |
| 2,948,223 | 8/1960 | Mashinter | 417/387 |
| 2,960,936 | 11/1960 | Dean et al. | 417/395 |
| 3,124,078 | 3/1964 | Hardy | 417/395 |
| 3,131,638 | 5/1964 | Wilson et al. | 417/388 |
| 3,433,161 | 3/1969 | Vetter | 417/388 |

FOREIGN PATENT DOCUMENTS

| | | | |
|---|---|---|---|
| 486,142 | 9/1975 | Czechoslovakia | 417/387 |

*Primary Examiner*—Carlton R. Croyle
*Assistant Examiner*—Thomas I. Ross
*Attorney, Agent, or Firm*—Fleit & Jacobson

[57] ABSTRACT

A high pressure pump in which at least one reciprocatingly driven piston acts on a hydraulic fluid communicating with one side of a diaphragm, the other side of the diaphragm communicating with a fluid to be displaced by the pump. The diaphragm is made of elastomeric material, and is relatively thick so that it is substantially self-restoring on the return stroke of the piston even in the event of total blockage of the supply of fluid to be displaced.

10 Claims, 6 Drawing Figures

DIAPHRAGM PUMP WITH PULSE PISTON POSITION RESPONSIVE WORK FLUID REPLENISHMENT

This invention relates to high pressure pumps. A particular application of the invention is to a high pressure pump which is required to work at a high efficiency, either because the available power is limited or because heating (as an inevitable result of inefficiency) is unacceptable.

One known type of high pressure pump is one in which the fluid to be pumped, for example, water, is acted upon by means of a reciprocating piston which is in direct contact with the pumped fluid. One problem with such a pump is the near impossibility of preventing seepage of lubricating oil into the pumped fluid. Another problem, in the case in which the pumped fluid is water, is that water is a bad lubricant, especially dirty, brackish or saline water, and causes wear of the piston and/or of the cylinder in which the piston reciprocates, as well as reducing efficiency because of friction.

Another known type of pressure pump is a diaphragm pump in which a flexible diaphragm which is sealed around its edge acts directly upon the fluid to be pumped. Examples known hitherto of this type of pump have had the problem that the diaphragm has a low thickness to diameter ratio and low resilience, requiring a spring to act upon the diaphragm, (causing wear,) to ensure that the diaphragm restores after a pumping movement, even (against normal atmospheric pressure), in the event of total blockage of the inlet to the pump. There is also the problem that the strain (i.e., stress-/Young's modulus) may be quite high in one or two places, with a concomitant risk of rupture of the diaphragm. However, a diaphragm is better able to provide a seal against ingress of foreign matter into the pumped fluid than a piston, as well as being less subject to friction and hence theoretically capable of greater efficiency.

As seen from one aspect of the invention there is provided a high pressure pump comprising a housing containing at least one diaphragm arranged to be actuated by means of at least one corresponding reciprocating piston through hydraulic fluid which substantially fills a space between the diaphragm and the piston and which acts directly upon one side of the diaphragm, an inlet valve and an outlet valve connecting a chamber on the other side of the diaphragm respectively to a supply passage and a discharge passage for fluid to be pumped, a replenishment valve being arranged to replenish the said space with hydraulic fluid during the return stroke of the piston to replace any hydraulic fluid lost during the pumping stroke of the piston, the resilience of the diaphragm acting against the piston on the pumping stroke and with the piston on the return stroke, characterised in that the diaphragm is made of elastomeric material and has a thickness to diameter ratio of at least 1:5, the said resilience being sufficient for the diaphragm to be substantially self-restoring on the return stroke of the piston even (against normal atmospheric pressure) in the event of total blockage of the inlet valve or of the supply passage.

Preferably, the thickness to diameter ratio of the diaphragm is at least 1:4, for example 1:3.

Preferably the diaphragm is part-spherical or cup-shaped and is oriented so that it flattens or tends to flatten out during the pumping stroke of the piston and thereby becomes more firmly held in an encircling portion of the housing.

Preferably the maximum operating strain of the diaphragm is less than 10%, preferably about 6%. This makes the diaphragm most unlikely to rupture.

All reciprocating piston pumps have an approximately constant output with respect to pressure which necessitates careful valving and control arrangements to avoid overloading the drive motor or over-pressurising the circuit. For a number of applications, a pump absorbing constant power from the drive motor for any given pressure or flow setting or a pump delivering a constant pressure independently of volume can be very advantageous. It is therefore desirable to provide a means of altering the volume of output of a piston pump smoothly and continuously while it is running, but without spilling any pump fluid at high pressure which would result in a loss in efficiency.

According to a further preferred feature of the present invention, the piston crown is transpierced by an axial orifice and a pin is provided which extends axially into the cylinder accommodating the piston, the pin being sealingly receivable in the orifice, and the position of the pin being axially adjustable to control the point in the stroke of the piston where a free end of the pin enters and seals the orifice, so that by adjustment of the position of the pin, the volume of fluid displaced by the piston at each stroke and hence the output pressure of the pump can be varied.

It may be possible to make this adjustment manually by means of a knurled knob or the like, but it is preferable to make use of a feedback system which can be adjusted to give different output characteristics. For this purpose the other end of the pin may be attached to a piston received in a control cylinder in which the fluid pressure is dependent on the output pressure of the pump, so that it is then possible to vary the output characteristics of the pump and to achieve an output which approximates to constant power over a working range of pressure and volume.

The invention will be further described by way of example with reference to the accompanying drawings, wherein.

Figure 1:
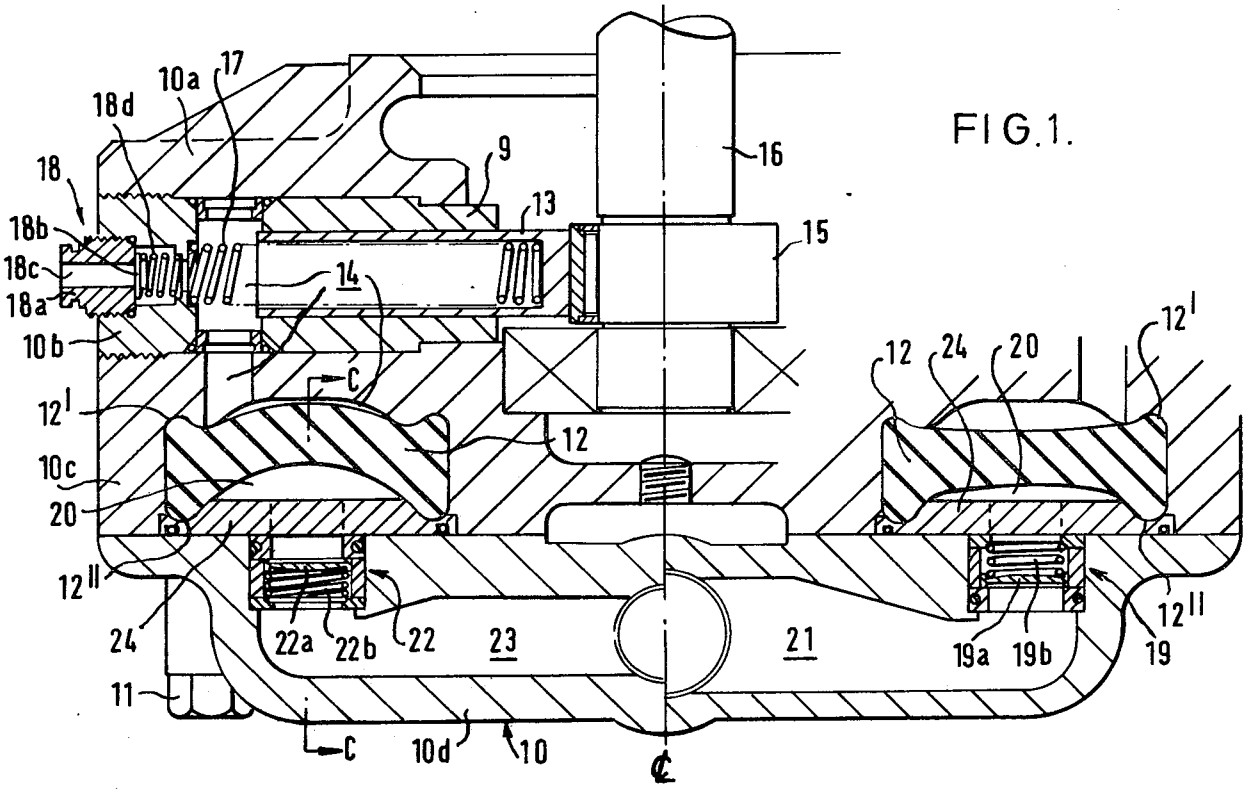
FIG. 1 is a sectional elevation through part of a high pressure pump in accordance with the invention, the pump being symmetrical about its center-line CL, the left-hand half of FIG. 1 being a section on line A—A of FIG. 2, the right-hand half of FIG. 1 being a section on line B—B of FIG. 2.
Figure 2:
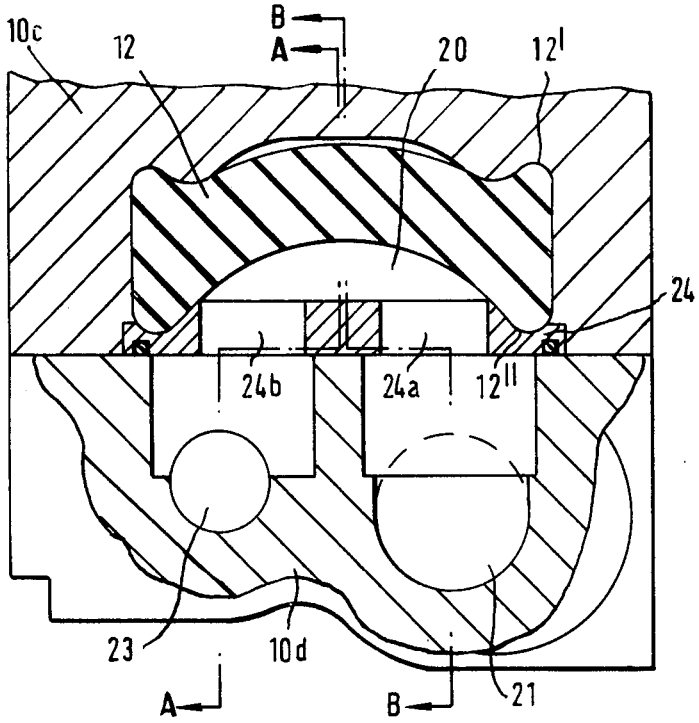
FIG. 2 is a section on line C—C of the left-hand half of FIG. 1.

The high pressure pump illustrated in FIGS. 1 and 2 comprises a housing 10 which is in four parts 10*a*, 10*b*, 10*c* and 10*d* held together by bolts such as bolt 11. The housing 10 contains two elastomeric diaphragms 12, one each side of the center-line CL. As shown in FIG. 1, the left-hand diaphragm 12 is arranged to be actuated by means of a corresponding piston 13, which is reciprocatingly drivable in a cylinder 9, through hydraulic fluid (not shown) which substantially fills a space 14 between the diaphragm 12 and the piston 13, the hydraulic fluid acting directly upon the upper side of the diaphragm 12. The pumping stroke of the piston 13, leftwards in FIG. 1, is effected by means of a rotary cam 15 which is mounted upon a camshaft 16 which rotates about the center-line CL. The return stroke of the piston 13, rightwards in FIG. 1, is effected by means of a compression spring 17 which acts between the housing part 10*b* and the right-hand end of piston 13. In order to replenish the space 14 with any hydraulic fluid lost through seepage during the pumping stroke, a replenishment valve 18 is provided in housing part 10*b* to connect the space 14 to an hydraulic fluid reservoir, not shown. The valve 18 comprises a valve body 18*a*, a closure disc 18*b* normally closing a passage 18*c* in valve body 18*a*, and a compression spring 18*d* acting upon the disc 18*b*.

Since the pump is symmetrical about the center-line CL, in addition to the second diaphragm 12, there is a second piston, not shown, a second space, not shown, a second return spring (not shown) for the second piston and a second replenishment valve, not shown, corresponding respectively to piston 13, space 14, spring 17 and valve 18. The cam 15 and camshaft 16 are common to the two pistons, which are operated in antiphase, each piston carrying out its respective pumping stroke while the other piston is carrying out its return stroke, and vice versa.

The right-hand half of FIG. 1 shows an inlet valve 19 connecting a chamber 20 on the lower side of the diaphragm 12 to a supply passage 21. Valve 19 comprises a valve disc 19*a* acted upon by a superjacent compression spring 19*b*.

The left-hand half of FIG. 1 shows an outlet valve 22 connecting the chamber 20 to a discharge passage 23. The valve 22 comprises a valve disc 22*a* acted upon by a subjacent compression spring 22*b*. The supply passage 21 and discharge passage 23 are common to the two sides of the pump.

Each diaphragm 12 is made of elastomeric material, for example, vulcanised rubber or 50 nitrile, and has a thickness to diameter ratio of approximately 1:3. Each diaphragm 12 is part-spherical or cup-shaped and is oriented with its concave side downwards and convex side upwards. Each diaphragm 12 is completely encircled by housing portion 10*c* and is seated upon a respective one of two support plates 24. A fluid-tight seal is obtained by pressure upon the upper rim 12' and the lower rim 12'' of the diaphragm 12. Each support plate 24 has apertures 24*a* and 24*b* to connect chamber 20 to passages 21 and 23 respectively. Each of diaphragms 12 is a body of revolution about a vertical center-line through the respective diaphragm. Each diaphragm 12 flattens or tends to flatten out, as shown for the right-hand diaphragm 12, during the pumping stroke of the respective piston. The diaphragm 12 thereby becomes more firmly held in the encircling portion 10*c* of the housing 10. The "normal" shape of each diaphragm 12 is as shown in the left-hand half of FIG. 1 and in FIG. 2. However, even when fully flattened, as shown in the right-hand half of FIG. 1, each diaphragm 12 is only under about 6% strain, and is therefore most unlikely to rupture. Because of the thickness to diameter ratio of 1:3 of each diaphragm 12, and because of the material of which it is made, each diaphragm is sufficiently strong or resilient to restore itself to the shape shown in the left-hand half of FIG. 1 and in FIG. 2, (without any need for any compression spring to act upon the underside of the diaphragm 12). Indeed, the resilience of each diaphragm 12 is sufficiently strong for this to be so even in the event of the inlet valve 19 or the supply passage 21 becoming blocked and producing a vacuum on the underside of the diaphragm 12, (which would then be subject to atmospheric pressure on its topside). Hence, there is no danger of the piston 13 drawing in excessive replenishment fluid through the valve 18 and then bursting the diaphragm 12 upon the next pumping stroke.

Figure 3:
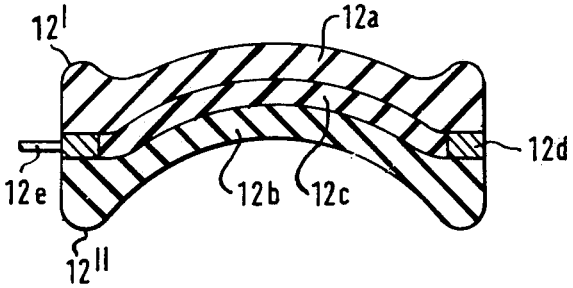
FIG. 3 is a section through a modified diaphragm.

In a modification, illustrated in FIG. 3, each diaphragm 12 comprises two substantially horizontal impervious outer layers 12*a* and 12*b* of elastomeric material such as vulcanized rubber or 50 nitrile, separated by a narrow (optional) interlayer 12*c* of soft rubber which extends across the middle of the thickness of the diaphragm and which is encircled by a porous rigid ring 12*d*, e.g., of sintered bronze, in between the two outer layers 12*a* and 12*b*. There is a vent 12*e* in the ring 12*d*. Should the upper outer layer 12*a* of the diaphragm 12 rupture, hydraulic fluid enters the interface between the interlayer 12*c* and layer 12*a*, flowing out through vent 12*e* so that it can be detected by suitable fluid-detecting means (not shown) to operate an alarm and/or stop the pump, without the hydraulic fluid mixing with the pumped fluid, since hopefully the lower outer layer 12*b* of the diaphragm 12 will still be intact. On the other hand, should the lower outer layer 12*b* of the diaphragm rupture, it would be pumped fluid which enters the interface between the interlayer 12*c* and layer 12*b*, flows out through vent 12*e* and is detected to operate the alarm and/or stop the pump, without mixing with the hydraulic fluid, since in this case the upper outer layer 12*a* of the diaphragm 12 will hopefully still be intact. The interlayer 12*c* should prevent chafing between the outer layers 12*a* and 12*b*. The rigidity of the ring 12*d* prevents blockage by rubber of the vent 12*e*, and also maintains the spacing-apart of the outer layers 12*a* and 12*b* at the periphery of the diaphragm, in spite of the pressure on the upper rim 12' and lower rim 12''. One of the outer layers 12*a* and 12*b* may be of a different elastomeric material from the other outer layer.

Figure 4:
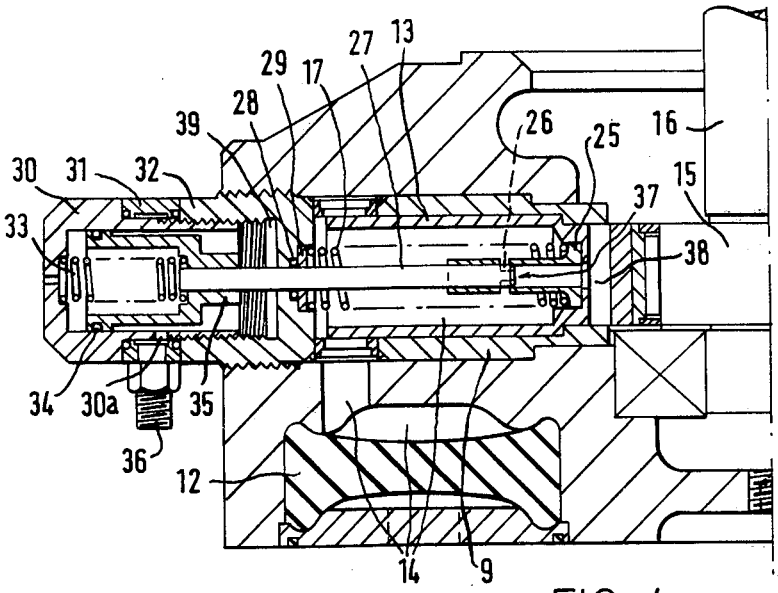
FIG. 4 is a partial sectional elevation corresponding to FIG. 1 showing a modified form of pump.

In the modified form of pump shown in partial sectional view in FIG. 4, the crown of the piston 13 is transpierced by an axial orifice in which is fitted an insert 25 consisting of a sleeve with control ports 26. This sleeve is a close fit on an axial control pin 27. Control pin 27 is attached to a piston 35 which can slide forwards and backwards in a control cylinder 30 which replaces the part 10*b* of the casing housing the replenishment valve 18 in FIG. 1. The pumping chamber 14 is sealed from a control cylinder 30 by O-ring 28.

In operation, as piston 13 travels into the pumping chamber during the power stroke oil bleeds through port 26 and passage 38 in the piston and returns to the crankcase until the free end 37 of pin 27 closes the port 26. As soon as port 26 is closed, oil is forced out of the pumping chamber 14 to drive the diaphragm.

During the return stroke of the piston, pin 27 uncovers ports 26 allowing oil to flow into the pumping chamber 14 from the crankcase.

By moving piston 35 in an outwards direction the free end 37 of pin 27 moves further outwards down pumping chamber 14 thus allowing more fluid to bleed through port 26 and 38 before it is confined in chamber 14 allowing a build up of pressure.

Control piston 35 is biased to the right by spring 33 but may be moved to the left by admitting oil through port 36. As oil is admitted through port 36 it flows round banjo ring 31 through transfer port 30*a* in cylinder 30 and into chamber 39. As more oil is admitted the piston is forced to the left.

Figure 5:
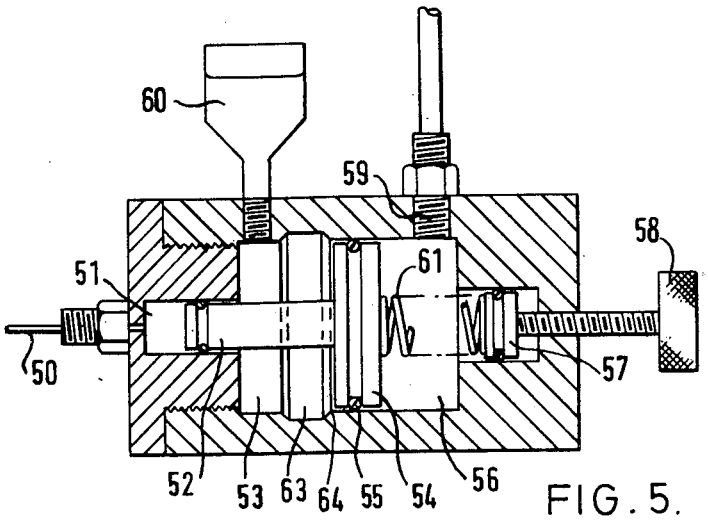
FIG. 5 is a sectional view of a feedback control device for the pump of FIG. 4.

The feedback control device for the pump of FIG. 4 shown in FIG. 5 can be constructed to give either constant pressure or constant volume characteristics to the pump.

Connection 50 is connected to the fluid output 23 of the pump. As the pressure at this port rises, piston 54 is forced to the right squeezing oil from chamber 56 through connection 59 which is in turn connected to port 36 of the control cylinder 30. As the pressure in port 50 rises more oil is forced through port 59 causing the control piston 35 to move to the left which in turn causes less oil to be pumped until such point as there is no further pumping action.

Spring 61 biases the piston 54 to the left and movement of the piston 54 and hence of the pin 27 which controls the pumping output depends on the area of the piston end 52 and the rate and strength and the spring 61. For example a spring 61 with a very low rate will allow piston 54 to travel to the right with a small increase in pressure once the initial tension has been overcome. This will give the pump a constant pressure output as shown in curve A of FIG. 6.

Figure 6:
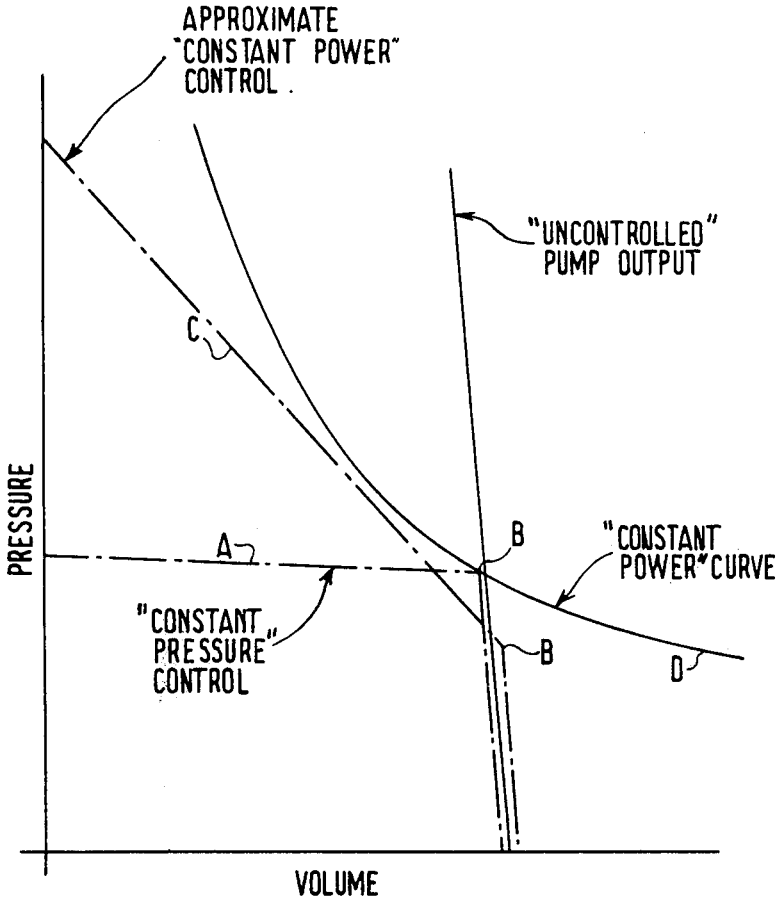
FIG. 6 is a graph showing pressure-volume output characteristics of the pump.

A spring 61 with a high rate requires relatively higher pressures to move it progressively to the right thus giving a pump output such as shown in curve C in FIG. 6. This curve can be made to fit the constant power curve D slightly more closely by fitting a variable rate spring which gives a lower spring rate at lower pressures than at higher pressures.

Adjusting knob 58 controls the position of piston 57, which in turn increases the initial tension on spring 61 and alters the point B on the curve at which control starts.

When the equipment ceases operation and the pressure in the circuit falls to zero, O-ring seal 55 in piston 54 ceases to seal as it becomes positioned over groove 63. This allows oil reservoir 60 to communicate with chamber 56 through chamber 53 and hence also to communicate with control cylinder chamber 39. Since changes in ambient temperature would alter the nominal zero position (i.e., the position of point B on the graph) this ensures that each time the equipment is started the passage of O-ring 55 past corner 64 resets position B irrespective of changes in temperature.

I claim:

1. A high pressure pump adapted for connection to a source of hydraulic fluid comprising:

a housing;

at least one diaphragm contained in said housing;

at least one reciprocating piston in said housing, spaced from said diaphragm for actuating said diaphragm, said reciprocating piston having pumping and return strokes;

means for supplying hydraulic fluid to the space between the diaphragm and the reciprocating piston, said means for supplying being adapted for connection to a source of hydraulic fluid and including a replenishment valve for replenishing the space with hydraulic fluid during the return stroke of the reciprocating piston to replace any hydraulic fluid lost during the pumping stroke of the reciprocating piston, the hydraulic fluid substantially filling the space between the diaphragm and the reciprocating piston, said diaphragm having one side directly acted upon by the reciprocating pump through the hydraulic fluid; and a chamber having an inlet valve and an outlet valve, said diaphragm having a second side in communication with said chamber, said inlet and outlet valves being adapted to respectively connect said chamber to a supply passage and a discharge passage for fluid to be pumped, the resilience of the diaphragm acting against the reciprocating piston on the pumping stroke and with the reciprocating piston on the return stroke, said diaphragm being made of elastomeric material and having a thickness to diameter ratio of at least 1:5, the resilience of said diaphragm being sufficient for said diaphragm to be substantially self-restoring on the return stroke of the reciprocating piston against normal atmospheric pressure in the event of total blockage of the inlet valve or of the supply passage.

2. A pump according to claim 1, wherein the thickness to diameter ratio of the diaphragm is at least 1:4.

3. A pump according to claim 1, wherein the thickness to diameter ratio of the diaphragm is at least 1:3.

4. A pump according to claim 1 wherein said housing includes an encircling portion for said diaphragm and wherein said diaphragm is part-spherical or cup-shaped and is oriented so that it flattens or tends to flatten out during the pumping stroke of the reciprocating piston and thereby becomes more firmly held in the encircling portion of the housing.

5. A pump according claim 1 wherein the maximum operating strain of the diaphragm is less than 10%.

6. A pump according to claim 1 wherein the maximum operating strain of the diaphragm is about 6%.

7. A high pressure pump adapted for connection to a source of hydraulic fluid comprising:

a housing having a first portion defining a first cylinder and a second portion defining a second cylinder;

a first piston positioned in said first cylinder and having a piston crown and an axial orifice transpiercing said piston crown;

means for connecting said orifice to a source of hydraulic fluid;

a pin extending axially into said first cylinder, said pin having a free end sealingly receivable in the orifice, the position of said pin being axially adjustable to control the point in the stroke of said first piston where the free end of said pin enters and seals the orifice, so that by adjustment of the position of said pin, the volume of fluid displaced by said first piston at each stroke and hence the output pressure of the pump can be varied;

at least one reciprocating piston located in said second portion of said housing and spaced from said diaphragm for actuating said diaphragm, said reciprocating piston having pumping and return strokes;

means for supplying hydraulic fluid to the space between the diaphragm and the reciprocating piston, said means for supplying being adapted for connection to a source of hydraulic fluid and including a replenishment valve for replenishing the space with hydraulic fluid during the return stroke of the reciprocating piston to replace any hydraulic fluid lost during the pumping stroke of the reciprocating piston, the hydraulic fluid substantially filling the space between the diaphragm and the reciprocating piston, said diaphragm having one side directly acted upon by the reciprocating pump through the hydraulic fluid; and a chamber having an inlet valve and an outlet valve, said diaphragm having a second side in communication with said chamber, said inlet and outlet valves being adapted to respectively connect said chamber to a supply passage and a discharge passage for fluid to be pumped, the resilience of the diaphragm acting against the reciprocating piston on the pumping stroke and with the reciprocating piston on the return stroke, said diaphragm being made of elastomeric material and having a thickness to diameter ratio of at least 1:5, the resilience of said diaphragm being sufficient for said diaphragm to be substantially self-restoring on the return stroke of the reciprocating piston against normal atmospheric pressure in the event of total blockage of the inlet valve or of the supply passage.

8. A pump according to claim 7 wherein said pin has a second end and wherein said pump further comprises a control cylinder, a control piston received in the control cylinder, and means responsive to the output pressure of the pump for controlling fluid pressure in the control cylinder, said second end of said pin being attached to said control piston.

9. A pump according to claim 8 including a feedback control device comprising two additional cylinders and two additional pistons received in said two additional cylinders and coupled together, one of said additional pistons being responsive to the output pressure of the pump and the other controlling fluid furnished said control cylinder, whereby a change in output pressure of the pump causes a movement of said one piston resulting in a movement of said other piston which in turn causes movement of the control piston in the control cylinder and hence of the pin controlling the output of the pump.

10. A pump according to claim 9 further comprising a reservoir and spring bias means associated with said other piston and wherein the one of said two additional cylinders associated with the other of said two additional pistons includes a first space communicating with the reservoir, a working space communicating with said control cylinder and a widened part positioned between the first and working spaces, said other piston being spring biased by said spring bias means into a rest position when the pump is inoperative in which said other piston is located in the widened part of said one cylinder such that fluid may flow from the first space communicating with the reservoir around said other piston into the working space of said one cylinder which communicates with the control cylinder.

* * * * *